US006325310B1

(12) United States Patent
Inoue

(10) Patent No.: US 6,325,310 B1
(45) Date of Patent: Dec. 4, 2001

(54) IMMERSION-TYPE DISPERSING APPARATUS

(75) Inventor: Masakazu Inoue, Tokyo (JP)

(73) Assignee: Inoue Mfg., Inc. (JP)

( * ) Notice: Subject to any disclaimer, the term of this patent is extended or adjusted under 35 U.S.C. 154(b) by 0 days.

(21) Appl. No.: 09/627,936

(22) Filed: Jul. 28, 2000

(30) Foreign Application Priority Data

Jul. 29, 1999 (JP) ..... 11-215286

(51) Int. Cl.[7] ..... B02C 23/36; B02C 17/16; B02B 1/08

(52) U.S. Cl. ..... 241/46.01; 241/65; 241/172

(58) Field of Search ..... 241/46.1, 65, 66, 241/172, 173, 174, 67, 181

(56) References Cited

U.S. PATENT DOCUMENTS

| | | | | |
|---|---|---|---|---|
| 4,856,717 | | 8/1989 | Kamiwano et al. | 241/65 |
| 4,919,347 | | 4/1990 | Kamiwano et al. | 241/65 |
| 5,346,147 | * | 9/1994 | Ishikawa et al. | 241/172 |
| 5,950,943 | * | 9/1999 | Stehr | 241/172 |
| 6,021,969 | * | 2/2000 | Schmitt et al. | 241/172 |
| 6,029,915 | * | 2/2000 | Inoue | 241/172 |

FOREIGN PATENT DOCUMENTS

| | | |
|---|---|---|
| 58174230 | 10/1983 | (JP) . |
| 60048126 | 3/1985 | (JP) . |
| 1210020 | 8/1989 | (JP) . |
| 3072932 | 3/1991 | (JP) . |
| 6086924 | 3/1994 | (JP) . |

* cited by examiner

*Primary Examiner*—W Donald Bray
(74) *Attorney, Agent, or Firm*—Adams & Wilks

(57) ABSTRACT

An immersion-type dispersing apparatus comprises a body, a tubular outer stator connected to the body, and a tubular inner stator disposed in the tubular outer stator and forming with the tubular outer stator an annular treatment gap for containing a dispersion medium. A rotor extends into the annular treatment gap and separates the annular treatment gap into an outer gap portion and an inner gap portion. A drive shaft is mounted for rotation to rotate the rotor. An axial flow shaft extends into the inner stator for rotation therein. Axial flow blades are mounted on the axial flow shaft for rotation therewith to generate a circulation flow for circulating a material to be treated into and out of the treatment gap. A circulation port is formed in the rotor and communicates the inner gap portion and the outer gap portion of the treatment gap to permit the material to be treated and the dispersing medium to flow to and from the inner and outer gap portions of the treatment gap. A discharge port is formed in the inner stator for discharging the material to be treated. A separating member is disposed in the discharge port for separating the dispersion medium from the material to be treated.

22 Claims, 5 Drawing Sheets

IMMERSION-TYPE DISPERSING APPARATUS

BACKGROUND OF THE INVENTION

1. Field of the Invention

The present invention relates to an immersion-type dispersing apparatus wherein a material to be treated (or mill base) containing solid particles and a treating liquid is finely ground using a dispersion medium and is dispersed in the treating liquid. More particularly, the present invention relates to an immersion-type dispersing apparatus wherein the dispersion medium is contained in a dispersion chamber and the dispersion chamber is immersed in the material to be treated for dispersion treatment.

2. Background Information

Various types of immersion-type dispersing apparatuses have been known wherein a dispersion chamber containing a dispersion medium is immersed in a tank and dispersion treatment is conducted by a batch system. These types of dispersing apparatuses are described in, for example, JP-B-59-46665 (JP-A-58-174230), JP-B-62-16687 (JP-A-60-48126), JP-B-5-82253 (JP-A-1-210020), JP-B-6-73620 (JP-A-6-86924) and JP-B-8-17930 (JP-A-3-72932). In these conventional immersion-type dispersing apparatuses, since pins, pegs or the like are used as a means for stirring the dispersion medium in the dispersion chamber, particle size reduction of the solid particles in the material to be treated tends to be insufficient. For example, the dispersed products are sometimes found to be ground to a level of only 10 $\mu$m in particle size.

Moreover, in conventional immersion-type dispersing apparatuses, since a drive shaft passes through a space where the dispersion medium moves in the dispersion chamber, the dispersion medium may sometimes clog in a through-hole portion or flow out from the through-hole portion.

SUMMARY OF THE INVENTION

It is an object of the present invention to provide an immersion-type dispersing apparatus by which the dispersibility of a material to be treated is improved over the conventional art.

Another object of the present invention is to provide an immersion-type dispersing apparatus by which it is possible to separately control the flow of the material to be treated in a tank and the flow of the dispersion medium in the dispersion chamber, and to prevent the clogging or outflow of the dispersion medium contained in the dispersion chamber.

The foregoing and other objects of the present invention are carried out by an immersion-type dispersing apparatus wherein a dispersion chamber containing a dispersion medium is immersed in a tank containing a material to be treated, the material to be treated is circulated into the dispersion chamber, and the material to be treated is dispersed by use of the dispersion medium moving within the dispersion chamber. A tubular outer stator and a tubular inner stator disposed inside of the tubular outer stator form an annular treatment gap in the dispersion chamber. A rotor extends into the annular treatment gap for partitioning the treatment gap into an outer gap portion and an inner gap portion. A drive shaft is mounted for rotation for rotating the rotor. An axial flow shaft is connected to the drive shaft for rotation therewith and is inserted into the inner side of the inner stator. A plurality of axial flow blades are mounted on the axial flow shaft for rotation therewith. During rotation of the axial flow blades, the material to be treated is allowed to flow into the treatment gap of the dispersion chamber. A circulation port is formed on the rotor so that a dispersion medium contained in the treatment gap and the material to be treated pass through the outer gap portion, flow in the inner gap portion and return to the outer gap portion. A discharge port is formed on the inner stator for discharging the material to be treated. A separating member is disposed at the discharge port for separating the dispersion medium from the material to be treated.

In one embodiment, the axial flow shaft and the drive shaft are rotated together using a single drive source. In another embodiment, the drive shaft and the axial flow shaft are arranged in a concentric biaxial construction, where the drive shaft has a hollow construction and the axial flow shaft is permitted to pass through the drive shaft to allow the axial flow shaft to rotate independently from the drive shaft. In the latter embodiment, the drive shaft and the axial flow shaft can be controlled independently by connecting each to a different rotational driving source.

The present invention further provides an immersion-type dispersing apparatus wherein flow-controlling surfaces are formed on appropriate surfaces of the rotor, outer stator, inner stator or the like by which the impact force or grinding force generated by the dispersion medium is further efficiently exerted to the material to be treated for highly improved dispersion. Preferably, the flow-controlling surface comprises an uneven surface configuration, projections, spiral grooves or the like.

BRIEF DESCRIPTION OF THE DRAWINGS

The foregoing summary, as well as the following detailed description of preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE PREFERRED EMBODIMENTS

While this invention is susceptible of embodiments in many different forms, this specification and the accompanying drawings disclose only certain forms as examples of the use of the invention. The invention is not intended to be limited to the embodiments so described, and the scope of the invention will be pointed out in the appended claims.

Figure 1:
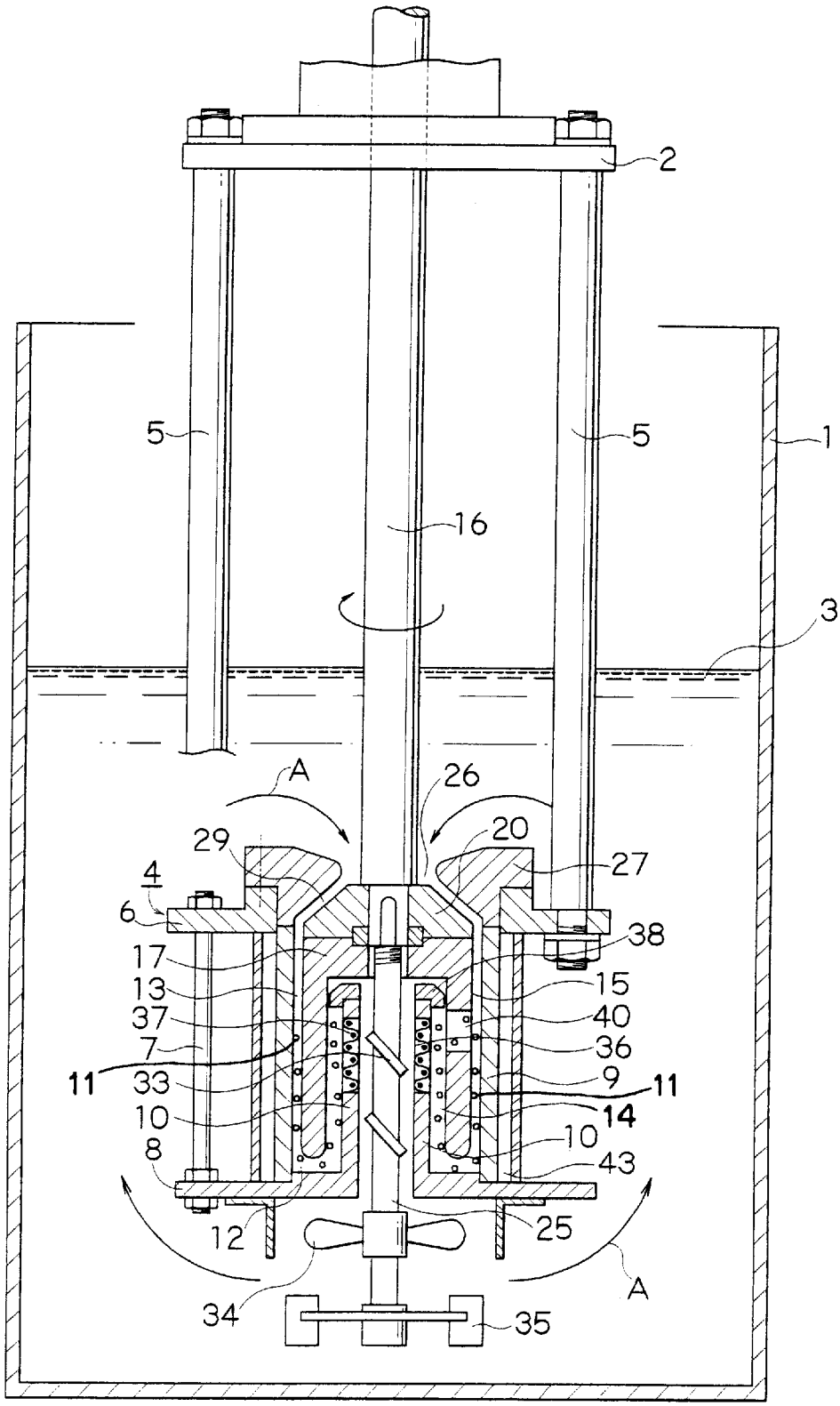
FIG. 1 is a partial cross sectional view of an embodiment of the immersion-type dispersing apparatus according to the present invention.
Figure 2:
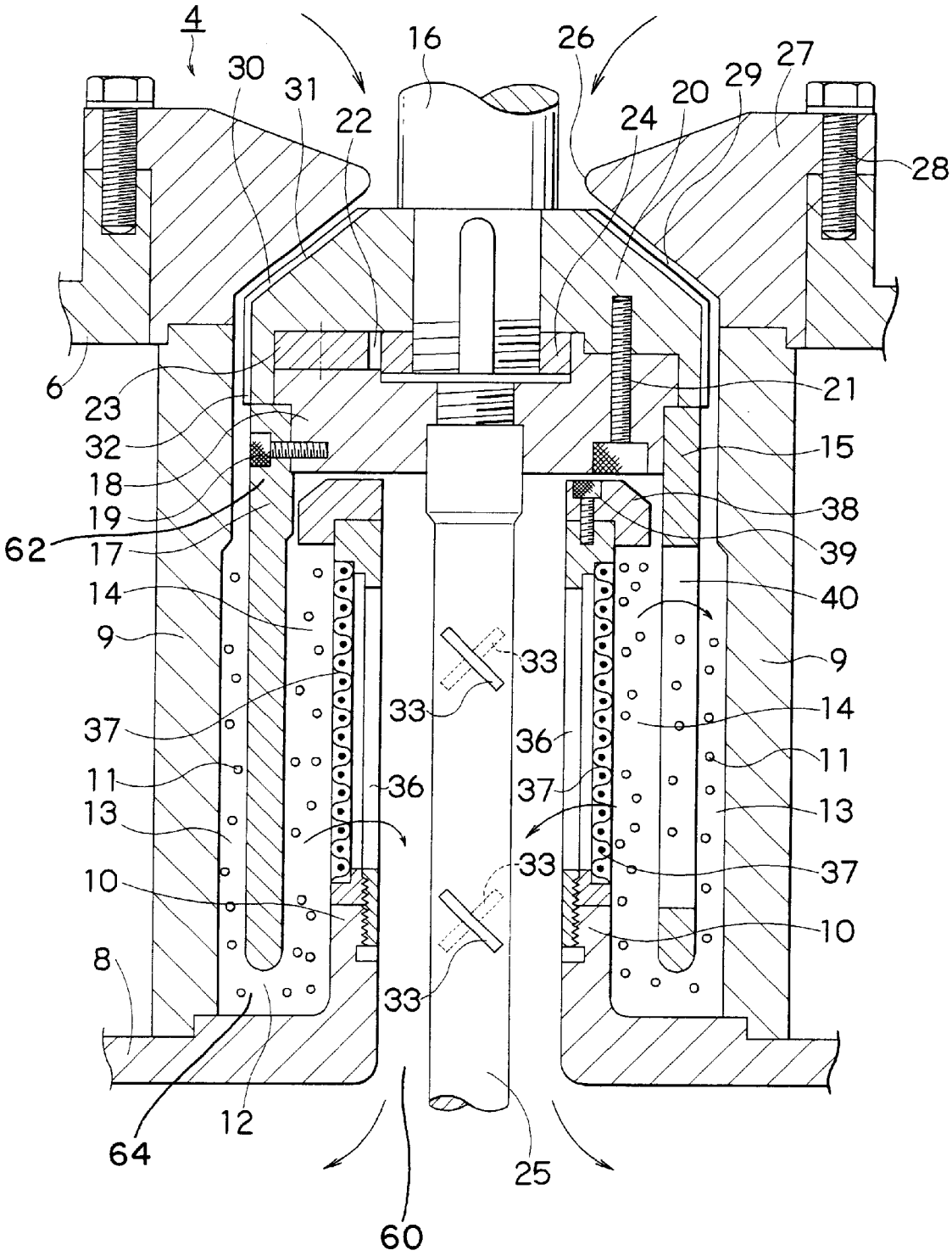
FIG. 2 is an enlarged cross sectional view showing a dispersion chamber of the immersion-type dispersing apparatus shown in FIG. 1.

Referring now to the drawings in detail, wherein like numerals are used to indicate like elements throughout, there is shown in FIGS. 1–5 embodiments of a immersion-type dispersing apparatus according to the present invention. As shown in FIGS. 1–2, a frame 2 is mounted for undergoing upward and downward movement relative to a tank 1 containing a material 3 to be treated. A dispersion chamber 4 is connected to the frame 2 through rods 5 so that when the frame 2 moves downward, the dispersion chamber 4 is immersed in the material 3 to be treated contained in the tank 1. A drive shaft 16 is mounted on the frame 2 and is driven by a motor (not shown) for undergoing rotation relative to the frame 2.

The dispersion chamber 4 has a body comprised of an upper face plate 6 which is attached to the rods 5 and a lower face (bottom) plate 8 which is connected to the upper face plate 6 through a stay 7. A tubular outer stator 9 is disposed between the upper face plate 6 and the lower face plate 8. A tubular inner stator 10 is disposed inside the outer stator 9 to form a bottomed annular treatment gap 12 for containing a dispersion medium 11 between the stators 9, 10. In this embodiment, the inner stator 10 is formed in one piece with the lower face plate 8 so that a through-hole 60 is formed at the center of the lower face plate 8. Alternatively, the inner stator 10 may be formed separately from the lower face plate 8 and then attached to the lower face plate 8. Furthermore, in this embodiment the outer stator 9 and the inner stator 10 are generally cylindrical-shaped. However, it is understood that other shapes, such as a polygonal tubular shape, are suitable for the outer stator 9 and the inner stator 10.

A tubular rotor 15 extends into the treatment gap 12 from an opening port side 62 thereof and separates the treatment gap 12 into an outer gap portion 13 and an inner gap portion 14. The outer gap portion 13 and the inner gap portion 14 communicate with each other at a front end side 64 of the treatment gap 12. The rotor 15 is attached to a lower end of the drive shaft 16 for rotation therewith to undergo rotation within the treatment gap 12. In this embodiment, the rotor 15 is generally cylindrical-shaped. However, other configurations, such as a polygonal tubular shape, are suitable for the rotor 15. In this annular-type dispersion system, the width of the treatment gap 12, particularly the width of the outer gap portion 13, may preferably be designed to have an appropriate width so as to exert efficiently the shearing force of the dispersion medium to the material to be treated when the rotor 15 is rotated.

Referring to FIG. 2, a connecting member 18 is fitted in an upper inner portion of a tubular rotor body 17 of the rotor 15 and is fixed to the rotor body 17 by a bolt 19. The connecting member 18 is also fitted in a rotor end portion 20 and is fixed to the rotor end portion 10 by a bolt 21. In this case, a receiving groove 22 formed on the connecting member 18 is engaged with an engaging piece 23 disposed on the rotor end portion 20 so as to hold the connecting member 18 against rotation. The end portion of the drive shaft 16 is inserted into the rotor end portion 20 and is fixed to the rotor end portion 20 by a nut 24 against rotation.

Figure 3:
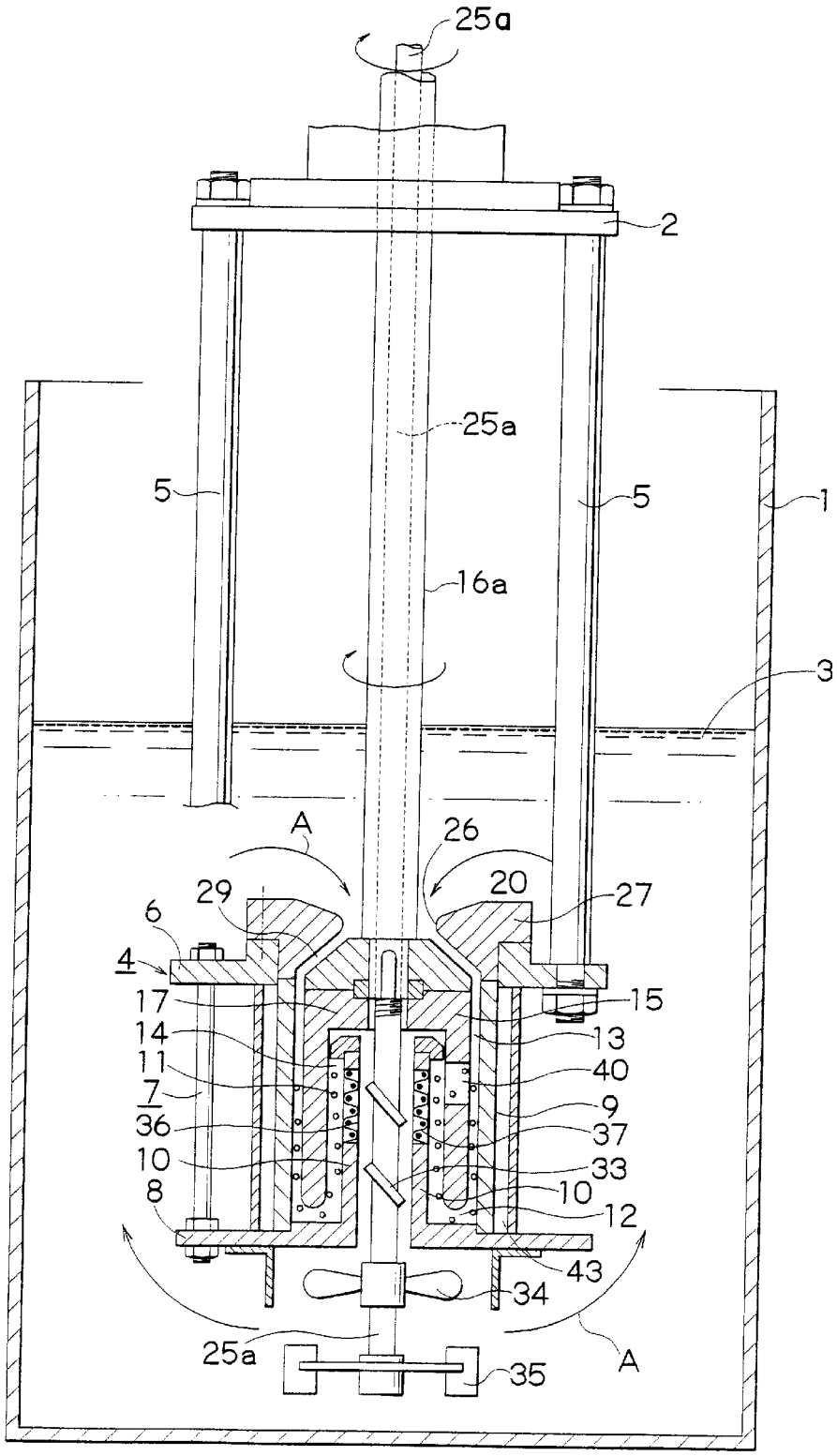
FIG. 3 is a cross sectional view of another embodiment of the immersion-type dispersing apparatus according to the present invention.

An axial flow shaft 25 is connected to the connecting member 18 and extends into the inner stator 10. In this embodiment, the axial flow shaft 25 is designed to rotate together with the drive shaft 16. Alternatively, if the axial flow shaft 25 is installed separately from the drive shaft 16, the axial flow shaft 25 and the drive shaft 16 can be rotated independently from one another. For example, FIG. 3 shows another embodiment of the immersion-type dispersing apparatus according to the present invention in which the axial flow shaft 25 and the drive shaft 16 can be rotated independently from one another. In this embodiment, a hollow drive shaft 16*a* is provided, and an axial flow shaft 25*a* is fitted into the hollow drive shaft 16*a* by which the hollow drive shaft 16*a* and the axial flow shaft 25*a* are constructed to have a concentric biaxial structure. The lower portion of the axial flow shaft 25*a* passes through the rotor 15 and extends toward the inside of the inner stator 10, and an upper portion of the axial flow shaft 25*a* is connected to a driving source (not shown) different from a driving source (not shown) for the drive shaft 16*a*. By separately controlling the driving sources for rotationally driving the respective shafts, it is possible to vary the rotational speed of the rotor and the rotational speed of the axial flow shaft.

The rotor end portion 20 at the upper portion of the rotor 15 preferably has a generally truncated conical shape. An inlet member 27 is attached to the upper plate 6 by bolt 28 and has a flow-in port 26 at a central part thereof covering a conical slope portion formed on the upper face of the rotor end portion 20. A conical gap 29 communicating with the outer gap portion 13 of the treatment gap 12 is formed between the rotor end portion 20 and the inlet member 27. Preferably, outflow-preventing projections are formed on an outer surface of the rotor end portion 20 or an inner surface of the inlet member 27 which define the conical gap 29 to prevent the dispersion medium 11 in the treatment gap 12 from flowing into the tank 1 from the flow-in port 26 through the conical gap 29.

Figure 4A:
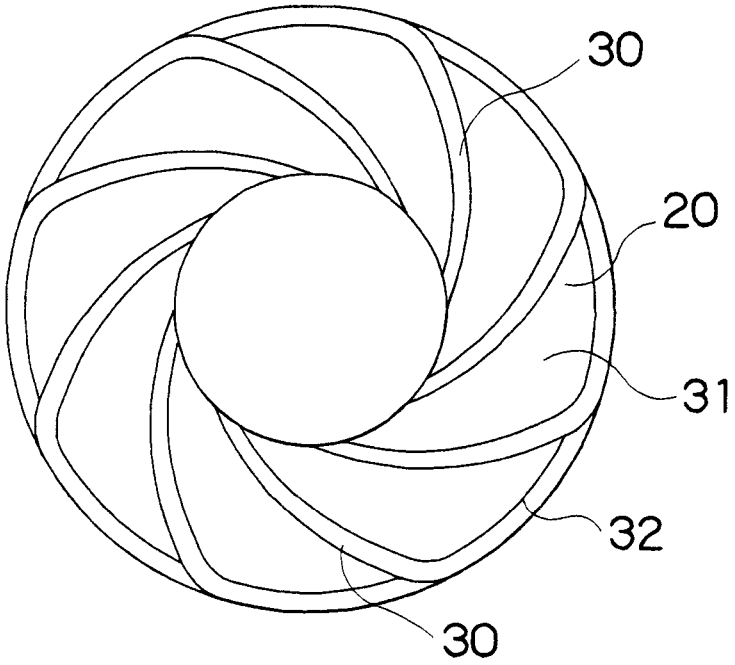
FIGS. 4(A) and 4(B) are a plane view and a front view, respectively, showing outflow-preventing projections disposed on a rotor of the immersion-type dispersing apparatus according to the present invention.
Figure 4B:
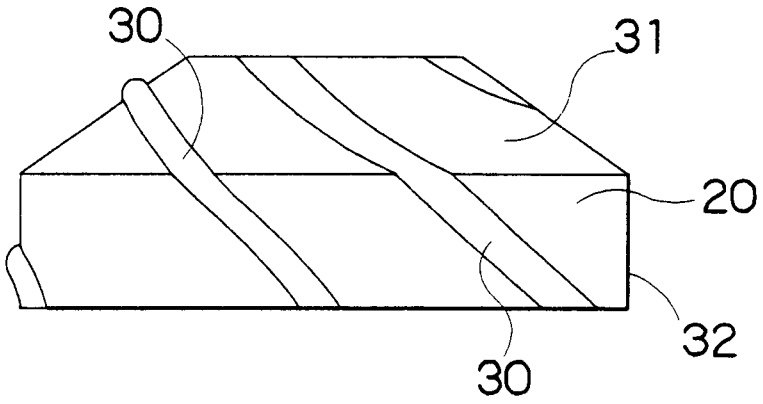

FIGS. 4(A)–4(B) show an embodiment of the outflow-preventing projections according to the present invention. In this embodiment, the outflow-preventing projections comprise spirally projected outflow-preventing projections 30 formed entirely over a conical slope portion 31 and a tubular surface portion 32 of the rotor end portion 20. When the rotor 15 is rotated, the dispersion medium 11 flowing from the treatment gap 12 toward the conical gap 29 flows against the outflow-preventing projections 30 and returns to the treatment gap 12. In another embodiment (not shown), the outflow-preventing projections may comprise spiral grooves formed in the surface of the rotor end portion 20 where the edges of the grooves function as the projections.

A plurality of axial flow blades 33–35 are mounted on the axial flow shaft 25 for controlling the flow of the material to be treated 3 in the tank 1 so that the material to be treated is permitted to flow into the treatment gap 12 of the dispersion chamber 4. In the embodiments shown in FIGS. 1 and 3, the axial flow blades comprise paddle blades 33 disposed inside the inner stator 10 for paddling so as to generate a downward flow toward the through-hole 60 of the face plate 8, an axial flow propeller 34 disposed below the paddle blades 33, and turbine blades 35 disposed below the axial flow propeller 34 and mounted to an end portion of the axial flow shaft 25. When the axial flow shaft 25 is rotated, the axial flow blades 33–35 generate a circulation flow, as depicted by arrow A, from a lower portion of the dispersion chamber 4 to an upper portion thereof (e.g., from the through-hole 60 of the lower face plate 8 to the flow-in port 26 of the inlet member 27).

The inner stator 10 has a discharge portion 36 for discharging the material to be treated from the dispersion chamber 4. A separating member, such as a screen 37, is mounted in the discharge portion 36 and is provided with flow holes, such as pores or slits, for separating the dispersion medium 11 from the material to be treated 3. A sealing cap 38 is fixed to an upper portion of the inner stator 10 by a bolt 39 to prevent the dispersion medium 11 from flowing out of the inner gap portion 14 of the treatment gap 12.

During rotation of the axial flow axis 25, a circulation flow of the material 3 to be treated is generated in the tank 1 and, at the same time, the dispersion medium 11 in the treatment gap 12 flows from the outer gap portion 13 to the inner gap portion 14. A circulation port 40 is formed in the rotor 15 to permit the dispersion medium 11 which has reached the inner gap portion 14 to return to the outer gap portion 13. The size, number and shape of the circulation port 40, and the location of the rotor 15 in which the circulation port is formed, are selected so that the dispersion medium 11 properly flows from the inner gap portion 14 to the outer gap portion 13. For example, the circular port 40 may comprise two long slits extending axially on the periphery of the rotor body 17.

Figure 5C:
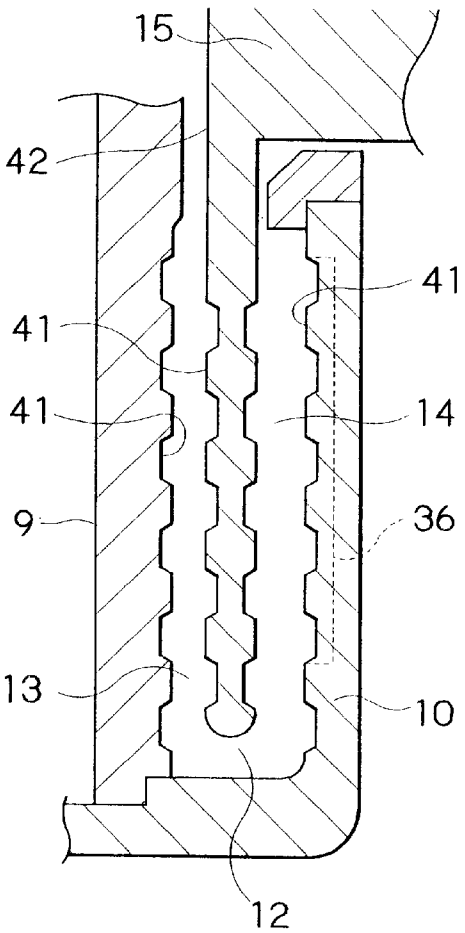
FIGS. 5(A), 5(B) and 5(C) are partial cross sectional views showing flow-controlling surfaces disposed on a rotor, an outer stator and an inner stator, respectively, of the immersion-type dispersing apparatus according to the present invention.
Figure 5B:
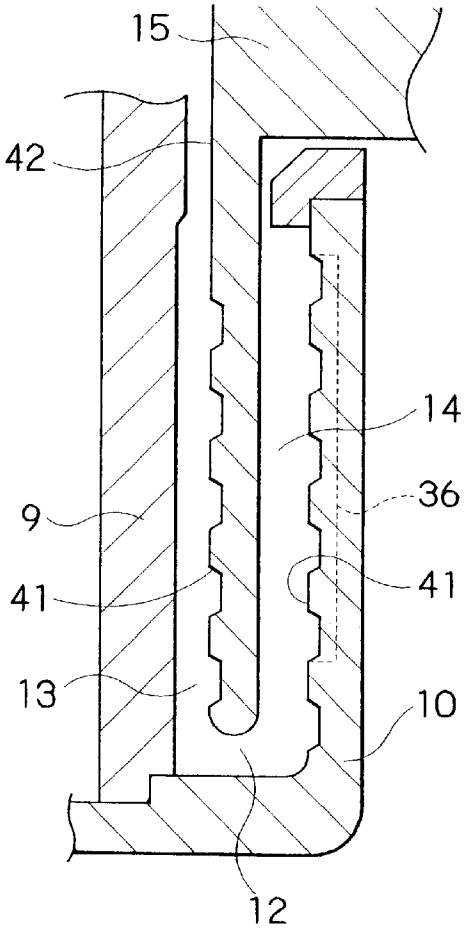
Figure 5A:
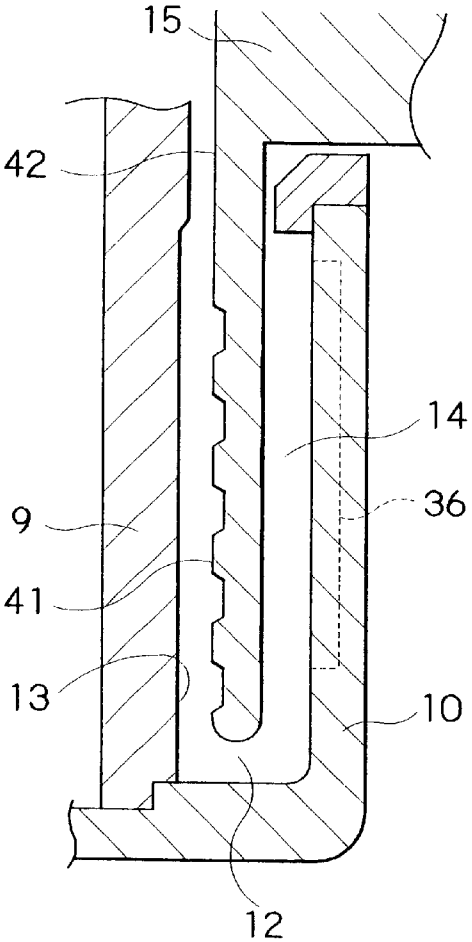

FIGS. 5(A)–5(C) show an embodiment of flow-controlling surfaces 41 for controlling the flow of the dispersion medium 11 and the material 3 to be treated during rotation of the rotor 15. In this embodiment, the flow-controlling surfaces 41 comprise projections formed on surfaces of one or more members facing the outer gap portion 13 or the inner gap portion 14. For example, the projections 41 may be provided only on the outer face of the rotor 15 as shown in FIG. 5(A), or on both the outer face of the rotor 15 and the outer face of the inner stator 10 as shown in FIG. 5(B). Alternatively, the projections 41 may be provided on inner and outer faces of the rotor 15, the inner face of the outer stator 9 and the outer face of the inner stator 10 as shown in FIG. 5(C). Other shapes for the flow-controlling surfaces include, for example, uneven surface portions, long slots, spiral grooves, screw-shaped grooves as described in U.S. Pat. No. 4,856,717, and spike-like projections as described in U.S. Pat. No. 4,919,347. It is understood that the type of the flow-controlling surfaces and the location for the flow-controlling surfaces are selected in accordance with the material to be treated and the dispersion effects desired.

When the flow-controlling surfaces 41 are provided on the entire outer face of the rotor 15, the movement of the dispersion medium 11 is accelerated, and accordingly the amount of the dispersion medium 11 flowing toward the flow-in port 26 side through the conical gap 29 tends to increase. According to the results of experiments, it has been confirmed that such tendency can be suppressed by forming a flat surface 42 at a part of about 1/7 to about 1/5 of the height of the outer face of the rotor 15, and below this part, forming the flow-controlling surfaces 41.

In the embodiment shown in FIG. 1, a jacket 43 for circulating a temperature-controlling medium, such as cooling water, is provided around an outer side of the outer stator 9. Alternatively, the jacket 43 may be provided around the rotor 15, or the jacket 43 may be left out completely.

During operation of the immersion-type dispersing apparatus according to the present invention, the treatment gap 12 of the dispersion chamber 4 is filled with the dispersing medium 11 to about 60 to 90% capacity. The dispersion chamber 4 is then immersed in the material 3 to be treated. Thereafter, the drive shaft 16 is rotated to thereby rotate the rotor 15 within the treatment gap 12. If the axial flow shaft 25 is connected to the drive shaft 16 as shown in FIG. 1, the axial flow shaft 25 rotates with the shaft 16 and the rotor 15, and a circulation flow (as depicted by the arrows A) of the material 3 to be treated is generated in the tank 1. Furthermore, when the axial flow shaft 25*a* is provided separately from the drive shaft 16*a*, as shown in FIG. 3, the circulation flow of the material 3 to be treated is generated by rotating the axial flow shaft 25*a* by a rotational driving source different from the rotational driving source for rotating the drive shaft 16*a*.

The material 3 to be treated circulating within the tank 1 enters the outer gap portion 13 of the treatment gap 12 through the flow-in port 26 of the dispersion chamber 4 and flows into the inner gap portion 14. During this period, the dispersion medium 11 to which movement is given by the rotor 15 functions to finely grind the solid particles in the material 3 to be treated by the impact force or the grinding force generated among the dispersion media, and the finely ground particles are dispersed in a liquid and then only the dispersed material is discharged into the tank 1 through the screen 37. By repeating the foregoing operation, the material 3 to be treated can be dispersed up to a desired dispersibility level.

When dispersion of hardly dispersible pigments was conducted using the immersion-type dispersion apparatus shown in FIG. 1, the desired particle size (e.g., at most 0.2 μm) was accomplished in 5 minutes as compared with 50 minutes when the dispersion was conducted using a conventional immersion-type dispersing apparatus.

By the foregoing construction of the immersion-type dispersion apparatus according to the present invention, a high level of dispersion for the material to be treated is achieved as compared to conventional dispersion apparatuses with stirring blades using pins or pegs. When the axial flow shaft and the drive shaft are arranged to be controlled independently from one another as described above for the embodiment of FIG. 3, the rotation of the rotor and the circulation flow in the tank can be controlled to achieve optimum conditions for the properties of the material to be treated. In addition, since the axial flow shaft is inserted inside of the inner stator and the axial flow shaft can be made to have no contact with the dispersion medium, it is possible to effectively avoid clogging or outflow of the dispersion medium, unlike the conventional apparatuses.

From the foregoing description, it can be seen that the present invention comprises an improved immersion-type dispersing apparatus. It will be appreciated by those skilled in the art that obvious changes can be made to the embodiments described in the foregoing description without departing from the broad inventive concept thereof. It is understood, therefore, that this invention is not limited to the particular embodiments disclosed, but is intended to cover all obvious modifications thereof which are within the scope and the spirit of the invention as defined by the appended claims.

What is claimed is:

1. An immersion-type dispersing apparatus comprising: a body; a tubular outer stator connected to the body; a tubular inner stator disposed in the tubular outer stator and forming with the tubular outer stator an annular treatment gap for containing a dispersion medium; a rotor extending into the annular treatment gap and separating the annular treatment gap into an outer gap portion and an inner gap portion; a drive shaft mounted for rotation to rotate the rotor; an axial flow shaft extending into the inner stator for rotation therein; a plurality of axial flow blades mounted on the axial flow shaft for rotation therewith to generate a circulation flow for circulating a material to be treated into and out of the treatment gap; a circulation port formed in the rotor and communicating the inner gap portion and the outer gap portion of the treatment gap to permit the material to be treated and the dispersing medium to flow to and from the inner and outer gap portions of the treatment gap; a discharge port formed in the inner stator for discharging the material to be treated; and a separating member disposed in the discharge port for separating the dispersion medium from the material to be treated.

2. An immersion-type dispersing apparatus according to claim 1; wherein the axial flow shaft is connected to the drive shaft for rotation therewith.

3. An immersion-type dispersing apparatus according to claim 1; wherein the drive shaft comprises a tubular drive shaft; and wherein the axial flow shaft extends through the tubular drive shaft and has an end portion extending into the inner stator and supporting the axial flow blades.

4. An immersion-type dispersing apparatus according to claim 3; further comprising rotational drive means for independently rotating each of the tubular drive shaft and the axial flow shaft.

5. An immersion-type dispersing apparatus according to claim 1; wherein the rotor has an upper end, a lower end and an external surface extending from the upper end to the lower end; and further comprising flow-controlling surfaces formed on the external surface of the rotor for controlling the flow of the dispersion medium and the material to be treated during rotation of the rotor.

6. An immersion-type dispersing apparatus according to claim 5; where in the flow-controlling surfaces comprise projections.

7. An immersion-type dispersing apparatus according to claim 5; wherein the flow-controlling surfaces comprise spiral grooves.

8. An immersion-type dispersing apparatus according to claim 5; wherein the rotor has a generally flat surface portion formed on the external face and extending a preselected distance from the upper end toward the lower end; and wherein the flow controlling surfaces extend from the preselected distance to the lower end of the rotor.

9. An immersion-type dispersing apparatus according to claim 8; wherein the preselected distance extends from about 1/7 to 1/5 of the distance between the upper end and the lower end of the rotor.

10. An immersion-type dispersing apparatus according to claim 1; wherein the rotor has an upper end, a lower end and an external surface extending from the upper end to the lower end; and further comprising flow-controlling surfaces formed on the external surface of the rotor and on the inner stator for controlling the flow of the dispersion medium and the material to be treated during rotation of the rotor.

11. An immersion-type dispersing apparatus according to claim 10; wherein the flow-controlling surfaces comprise projections.

12. An immersion-type dispersing apparatus according to claim 11; wherein the flow-controlling surfaces comprise spiral grooves.

13. An immersion-type dispersing apparatus according to claim 10; wherein the rotor has a generally flat surface portion formed on the external surface and extending a preselected distance from the upper end toward the lower end; and wherein the flow-controlling surfaces extend from the preselected distance to the lower end of the rotor.

14. An immersion-type dispersing apparatus according to claim 13; wherein the preselected distance extends from about 1/7 to 1/5 of the distance between the upper end and the lower end of the rotor.

15. An immersion-type dispersing apparatus according to claim 1; wherein the rotor has an upper end, a lower end and an external surface extending from the upper end to the lower end; and further comprising flow-controlling surfaces formed on the external surface of the rotor, on the inner stator and on an inner surface of the outer stator for controlling the flow of the dispersion medium and the material to be treated during rotation of the rotor.

16. An immersion-type dispersing apparatus according to claim 15; wherein the flow-controlling surfaces comprise projections.

17. An immersion-type dispersing apparatus according to claim 15; wherein the flow-controlling surfaces comprise spiral grooves.

18. An immersion-type dispersing apparatus according to claim 15; wherein the rotor has a generally flat surface portion formed on the external surface and extending a preselected distance from the upper end toward the lower end; and wherein the flow-controlling surfaces extend from the preselected distance to the lower end of the rotor.

19. An immersion-type dispersing apparatus according to claim 18; wherein the preselected distance extends from about 1/7 to 1/5 of the distance between the upper end and the lower end of the rotor.

20. An immersion-type dispersing apparatus according to claim 1; wherein the rotor has a generally conical-shaped upper portion; and further comprising an inlet member having an inlet port and having preselected inner surface portions disposed over preselected outer surface portions of the upper portion of the rotor to form therebetween a generally conical gap communicating with the outer gap portion of the treatment gap.

21. An immersion-type dispersing apparatus according to claim 20; further comprising a plurality of projections formed on the preselected outer surface portions of the rotor for preventing the outflow of the dispersion medium from the inlet port.

22. An immersion-type dispersing apparatus according to claim 20; further comprising a plurality of projections formed on the preselected inner surface portions of the inlet member for preventing the outflow of the dispersion medium from the inlet port.

* * * * *